US007629522B1

(12) United States Patent
Isaacson

(10) Patent No.: US 7,629,522 B1
(45) Date of Patent: Dec. 8, 2009

(54) SPRINGED PICK PINCHER

(76) Inventor: Adam M. Isaacson, 309 Creekside Dr., Buffalo, Wright, MN (US) 55313

( * ) Notice: Subject to any disclaimer, the term of this patent is extended or adjusted under 35 U.S.C. 154(b) by 0 days.

(21) Appl. No.: 11/868,343

(22) Filed: Oct. 5, 2007

(51) Int. Cl.
*G10D 3/16* (2006.01)
*G10D 3/00* (2006.01)
*G10D 1/06* (2006.01)

(52) U.S. Cl. ..... 84/322; 84/173; 84/290; 84/320; 84/258; 84/329

(58) Field of Classification Search ..... 84/322
See application file for complete search history.

(56) References Cited

U.S. PATENT DOCUMENTS

| | | | | |
|---|---|---|---|---|
| 1,645,918 | A | 10/1927 | Adolph | |
| 1,784,934 | A | 12/1930 | Wilhelm | |
| 3,181,410 | A | 5/1965 | Phillips | |
| 3,595,118 | A | 7/1971 | Paxton | |
| 3,752,029 | A | 8/1973 | Watrous | |
| 4,067,255 | A | 1/1978 | Camaioni | |
| 4,135,431 | A * | 1/1979 | Ferguson | 84/329 |
| 4,467,693 | A | 8/1984 | Nasfell, Jr. | |
| 4,779,778 | A | 10/1988 | Nixon, II | |
| 4,785,708 | A | 11/1988 | Vaughan | |
| 4,790,232 | A | 12/1988 | Rosen | |
| 4,890,531 | A | 1/1990 | Tischer | |
| D309,674 | S | 8/1990 | Gervase | |
| 4,982,641 | A | 1/1991 | Duhart | |
| 5,127,300 | A | 7/1992 | Silverman | |
| 5,299,485 | A | 4/1994 | Denton | |
| D355,667 | S | 2/1995 | Burger | |
| 5,398,582 | A * | 3/1995 | Smith | 84/383 R |
| 5,649,634 | A | 7/1997 | Irizarry | |
| 5,651,468 | A | 7/1997 | Irizarry | |
| 5,796,021 | A | 8/1998 | Longshore | |
| 6,054,643 | A | 4/2000 | Chance et al. | |
| 6,215,052 | B1 | 4/2001 | Giddens et al. | |
| 6,283,421 | B1 | 9/2001 | Eason et al. | |
| 6,846,977 | B2 | 1/2005 | Oskorep | |
| 7,186,908 | B2 | 3/2007 | Hodesh et al. | |
| 7,199,295 | B2 | 4/2007 | Oskorep | |
| 7,205,467 | B2 | 4/2007 | Tafolla et al. | |

* cited by examiner

*Primary Examiner*—Jeffrey Donels
*Assistant Examiner*—Christopher Uhlir
(74) *Attorney, Agent, or Firm*—Albert W. Watkins

(57) ABSTRACT

A moving jaw (20) is spring-urged (45, 55) against a fixed jaw (10, 110), to capture picks (70) and other like stringed musical instrument accessories therebetween. The fixed jaw (10, 110) is configured for either adhesive mounting (60) onto and extending exterior to a stringed instrument surface, or embedding interior to and coupled (118, 131) with the surface (80) of the stringed instrument. Picks (70) or other accessories are oriented perpendicular to the instrument surface (80), and one or a plurality of picks (70) may be inserted into and removed from between the jaws (10, 20, 110).

11 Claims, 3 Drawing Sheets

SPRINGED PICK PINCHER

BACKGROUND OF THE INVENTION

1. Field of the Invention

This invention pertains generally to the field of stringed musical instruments, and more particularly to a pick holder which may be coupled thereto.

2. Description of the Related Art

Even today, with our vast, highly complex methods of measuring and evaluating, man does not fully understand the functioning of the brain. What we do know is that development of the brain is most complete not only with development of applied skills such as reading, writing, and arithmetic, the so-called three R's, but also with far more abstract and less quantified skills generally categorized as the arts. These arts are believed by many to be essential to the fostering of creativity, and are often identified as the skills or talents which in large part separate man from machine.

One such art is the creation of music. The complexities of sounds have for the most part been very well measured and identified, and can therefore be reproduced electronically. However, the synthesis of a sequence of sounds, which is of course necessary for the creation of music, does not come simply from the laying together of various frequency plots on a computer. Instead, there is a synergy that comes form the interaction of man and instrument. This interaction has evolved for thousands of years, and has led to the development of highly refined musical instruments that are very optimal for the synthesis of music.

A large class of instruments that remains in very widespread use is that of the stringed instruments. These instruments, which have many shapes, geometries and consequently many different sounds produced thereby, include guitars, violins, cellos, and so forth. Many of these instruments are designed to be played using a variety of devices to produce vibration in the strings. Depending upon the device or plurality of devices used to induce vibration, the sounds generated thereby may be changed. As but one very simple example of direct relevance to the present invention, a guitar may be strummed using one's fingers directly, manually plucked, or played using a pick designed to engage with the strings instead of the person's fingers. Many other stringed instruments are also commonly played using some combination of fingers, picks and other tools. As but one example, a cello is plucked, strummed using fingers or pick, and played with a bow.

A musician interacting with an instrument is often faced with an undesirable dilemma. When the musician wishes to change the way the stringed instrument is played, alternative vibration inducing devices must be placed somewhere out of the way. In the case of a guitar or cello, the musician will be using one hand to induce vibration, either directly or with another device, and will be using the other hand to press against the strings to control the notes and nature of the vibrations. Consequently, the musician simply cannot hold onto additional vibration inducing devices. Nevertheless, there is much desire on the part of many musicians to be able to select from one or a plurality of vibration inducing devices, most preferably during a single contiguous performance. Such selection will most preferably then be made and executed in the midst of playing the instrument. In other instances, a musician may simply need back-up vibration inducing devices, such that should one fail or accidentally be dropped, the musician will have another readily available to not interrupt the performance.

Recognizing this need and desire, many artisans have proposed accessories which are designed to retain vibration inducing devices such as picks when not in immediate grasp and use by a musician. Exemplary patents which illustrate the different approaches from the prior art, the contents of each which are incorporated herein by reference for their teachings, include: U.S. Pat. No. 4,785,708 by Vaughan, entitled "Pick holder for stringed instruments;" U.S. Pat. No. 4,790,232 by Rosen, entitled "Holder for a guitar slide and pick;" U.S. Pat. No. 4,982,641 by Duhart, entitled "Guitar pick holder;" U.S. Pat. No. 5,127,300 by Silverman, entitled "Pick holder for a stringed musical instrument;" Des 355,667 by Burger, entitled "Guitar pick holder;" U.S. Pat. No. 5,649,634 by Irizarry, entitled "Holder for thin planar objects;" U.S. Pat. No. 6,054,643 by Chance et al, entitled "Guitar pick with gripping means;" U.S. Pat. No. 6,215,052 by Giddens et al, entitled "Guitar pick holder;" U.S. Pat. No. 6,639,136 by Judd, entitled "Guitar pick holder;" U.S. Pat. No. 4,890,531 by Tischer, entitled "Musical instrument pick holder;" U.S. Pat. No. 5,299,485 by Denton, entitled "Stringed instrument pick and slide holder;" U.S. Pat. No. 1,645,918 by Miele, entitled "Pick container;" U.S. Pat. No. 1,784,934 by Wilhelm, entitled "Plectrum holder;" U.S. Pat. No. 3,181,410 by Phillips, entitled "Guitar pick retention;" U.S. Pat. No. 3,595,118 by Paxton, entitled "Guitar pick;" U.S. Pat. No. 3,752,029 by Watrous, entitled "Pickholder;" U.S. Pat. No. 4,067,255 by Camaioni, entitled "Retractable guitar pick;" U.S. Pat. No. 4,135,431 by Ferguson, entitled "Stringed musical instrument pick dispenser;" U.S. Pat. No. 4,467,693 by Nasfell Jr, entitled "Holder for guitar plectra;" U.S. Pat. No. 4,779,778 by Nixon II, entitled "Music article jewelry system;" Des 355,667 by Burger, entitled "Guitar pick holder;" U.S. Pat. No. 5,651,468 by Irizarry, entitled "Holder for thin planar objects;" U.S. Pat. No. 5,796,021 by Longshore, entitled "Pick holder for guitars and other stringed instruments;" U.S. Pat. No. 6,283,421 by Eason et al, entitled "Instrument support system;" U.S. Pat. No. 6,846,977 by Oskorep, entitled "Guitar pick stickers which impart a magnetic attraction to synthetic guitar picks;" U.S. Pat. No. 7,186,908 by Hodesh et al, entitled "Stringed musical instrument pick with inert adhesion;" U.S. Pat. No. 7,199,295 by Oskorep, entitled "Guitar pick holder made of a flexible synthetic layer of material which is sufficiently plasticized such that guitar picks cling to its outer surface when depressed thereagainst;" U.S. Pat. No. 7,205,467 by Tafolla et al, entitled "Strap with accessory;" and Des 309,674 by Gervase, entitled "Guitar pick holder." In addition to the patents incorporated by reference herein above, Webster's New Universal Unabridged Dictionary, Second Edition copyright 1983, is also incorporated herein by reference in entirety for the definitions of words and terms used herein.

Many of the foregoing pick holders provide retention of only a single pick. Others which provide for the storage of a plurality of picks require a substantial amount of space, which may interfere with or detract from the use and appearance of the musical instrument, and which may undesirably be disturbed during playing of the instrument. Some of the apparatus proposed will not reliably hold the pick, and will instead drop the pick during movement of an instrument. As a result, such apparatus are only useful for a limited number of instruments that are not moved about or shaken during a performance. Other more compact storage techniques do not permit access to each one of a plurality of stored picks. Consequently, in spite of the very large number of patents of the prior art, there remains a need for a better and more suitable means to hold and store picks.

SUMMARY OF THE INVENTION

In a first manifestation, the invention is a holder for picks and other stringed musical instrument accessories. The holder has a fixed jaw having a body, a top surface, a bottom surface, and a pick retention surface. A moving jaw has a body, a top surface, a bottom surface, and a pick retention surface. At least one longitudinally extensive member spans between the fixed and moving jaws and serves as a guide that limits relative movement therebetween. At least one force applicator urges the moving jaw towards engagement with the fixed jaw.

In a second manifestation, the invention is an apparatus for pinching and retaining stringed musical instrument picks to a stringed musical instrument. The apparatus has a rigid fixed jaw having a body, a top surface, a bottom surface, a pick retention surface extending between top and bottom surfaces, and first and second bores extending through the pick retention surface. A rigid moving jaw has a body, a top surface, a bottom surface, and a pick retention surface. First and second rigid bolts are rigidly anchored to the moving jaw and protrude therefrom, each having a shaft and terminating distal to the moving jaw at a head. The first bolt extends into the first bore and the second bolt extends into the second bore. A first compression spring is located within the first bore concentric about the first bolt, and applies a force between the first bolt head and first bore, and thereby urges the moving jaw towards engagement with fixed jaw. A second compression spring is located within the second bore concentric about the second bolt, and applies a force between the second bolt head and second bore, and thereby urges the moving jaw towards engagement with fixed jaw.

In a third manifestation, the invention is a method for storing and retrieving a pick for a stringed musical instrument having an exterior surface. According to the method, the pick is oriented generally normal to the stringed musical instrument exterior surface. The pick is manually pressed towards the stringed musical instrument exterior surface and into engagement with a junction between jaws moveable relative to each other and urged towards each other by a closing force. The moveable jaws are separated responsive to the manual pressing, by overcoming the closing force. During the separating step, the moveable jaws are guided along a generally linear path. The pick is manually released subsequent to the manual pressing step. Subsequent to the manual releasing step, the pick is grasped. The pick is manually pulled away from the stringed musical instrument exterior surface and out of engagement with a junction between moveable jaws; and the moveable jaws are moved together responsive to the closing force and disengagement of the pick from the junction between moveable jaws.

OBJECTS OF THE INVENTION

Exemplary embodiments of the present invention solve inadequacies of the prior art by providing a fixed jaw and a moving jaw spring-urged against the fixed jaw. The fixed jaw is configured for either adhesive mounting onto and extending exterior to a stringed instrument surface, or embedding interior to and coupled with the surface of the stringed instrument. Picks or other similar accessories may be oriented perpendicular to the instrument surface, and one or a plurality of picks may be inserted into and removed from between the jaws.

A first object of the invention is to provide a method and apparatus for coupling a pick to a stringed instrument, and thereby relieving a musician from holding the pick when so desired. A second object of the invention is to ensure that the pick is reliably held, such that unless specifically desired otherwise, the pick remains coupled with the stringed instrument. Another object of the present invention is to permit either one or a plurality of picks to be held reliably. A further object of the invention is to permit the musician to access individual ones of stored picks, such that any one of the picks is accessible. Yet another object of the present invention is to provide for coupling to the guitar which is as compact as reasonably possible, and which does not interfere with the design, construction or use of the guitar in any undesirable way. An even further object of the invention is to provide a pick holder which is capable of outlasting the life of the stringed instrument to which it is attached.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
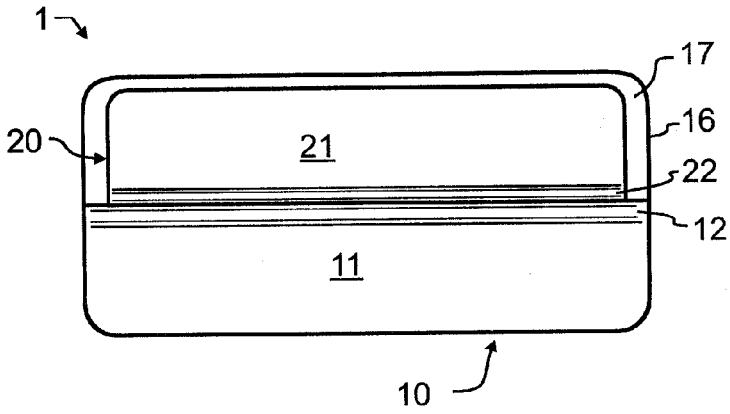
FIG. 1 illustrates a first preferred embodiment springed pick pincher designed in accord with the teachings of the present invention from a top plan view.
Figure 2:
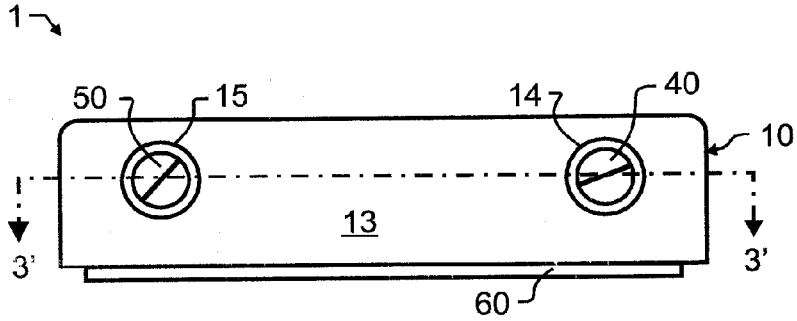
FIG. 2 illustrates the first preferred embodiment springed pick pincher of FIG. 1 from a side plan view.

Manifested in the first and second preferred embodiment springed pick pinchers, the present invention provides a method and compact apparatus for coupling a pick to a stringed instrument. One or a plurality of picks may be reliably held, and still individually accessed, such that unless specifically desired otherwise, each pick remains coupled with the stringed instrument.

The first preferred embodiment springed pick pincher 1 is illustrated in FIGS. 1-5. Fabricated from only six discrete components, springed pick pincher 1 has a fixed jaw 10 and a moving jaw 20 nested adjacent to fixed jaw 10. Anchored into and extending from moving jaw 20 is at least one rod or post, which in the preferred embodiment is manifested by a shoulder bolt 40. The specific component used is not critical to the invention, but a shoulder bolt or similar threaded fastener is preferred owing to its ready availability and ease of coupling at the time of assembly through threading 43. Nevertheless, other suitable fasteners may be used, and may be coupled to moving jaw 20 through other suitable techniques, such as welding, friction fitting, adhesives or other techniques too numerous to specifically mention herein.

Figure 3:
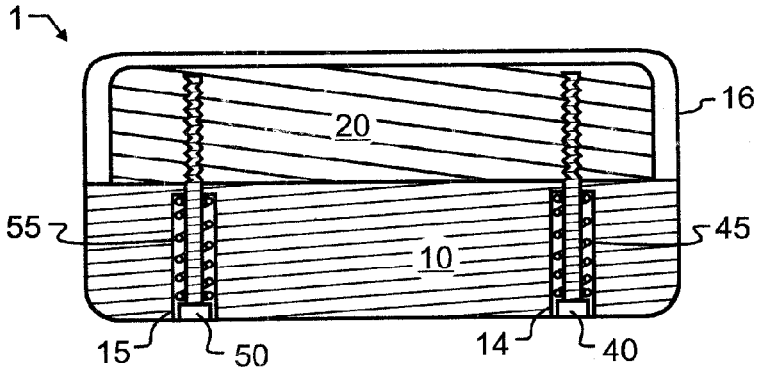
FIG. 3 illustrates the first preferred embodiment springed pick pincher of FIG. 1 from a top sectional view taken along section line 3' of FIG. 2.
Figure 4:
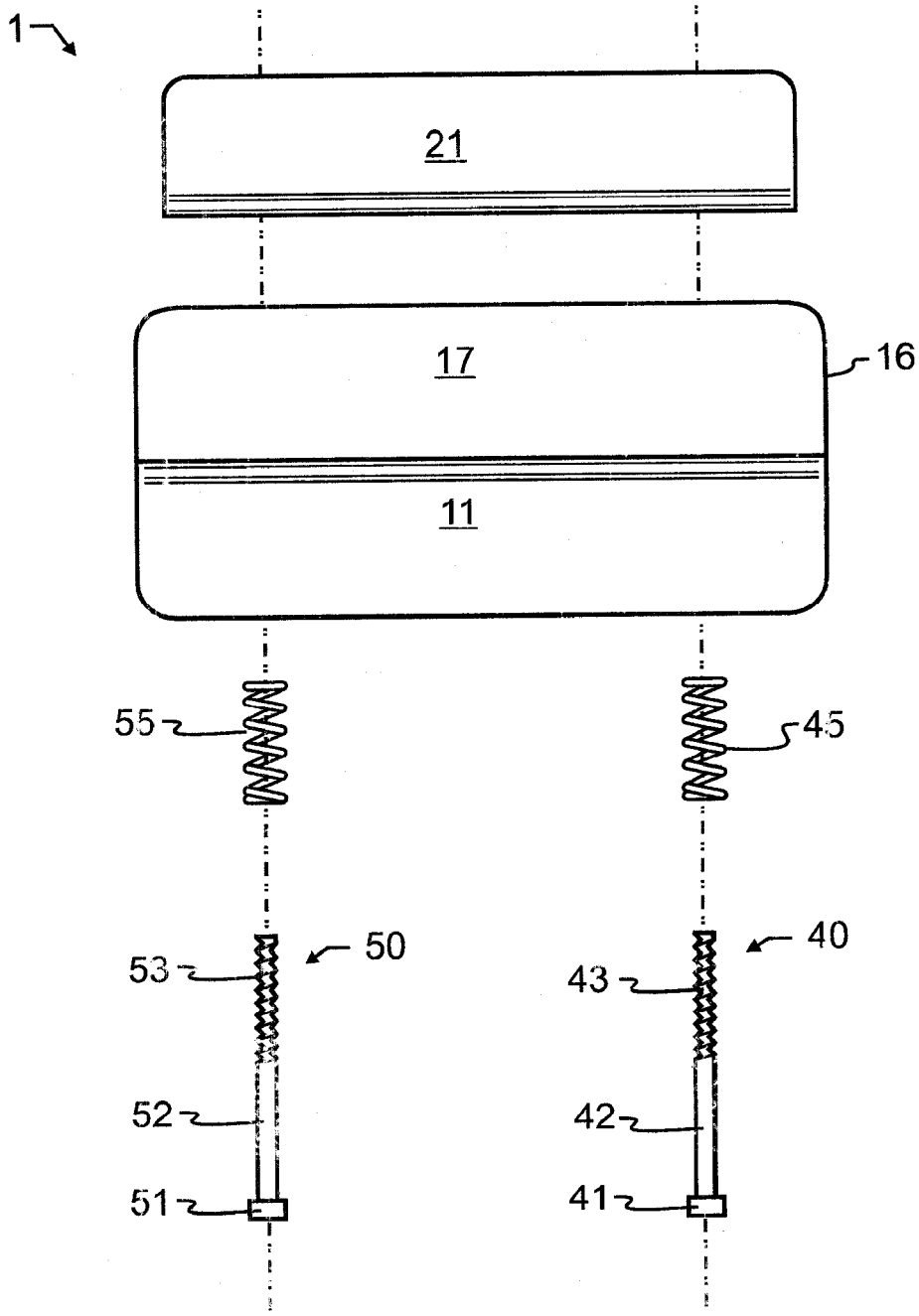
FIG. 4 illustrates the first preferred embodiment springed pick pincher of FIG. 1 from a top exploded view.

Moving jaw 20 is spring-urged against fixed jaw 10 by at least one spring, such as compression spring 45, which is captured between fixed jaw 10 within bore 40 and shoulder bolt head 41. When compression spring 45 is fully expanded, such as illustrated in FIGS. 1 and 3, shoulder bolt head 41 will be retained just within bore 40 interior to side surface 13 to preserve a smooth and simple exterior profile for springed pick pincher 1. When one or a plurality of picks 70 are inserted between jaws 10, 20, compression spring 45 will be compressed, such that shoulder 42 of shoulder bolt 40 will span a gap between jaws 10, 20. Since compression spring 45 is now more compressed, it will provide a force which urges moving jaw 20 back towards fixed jaw 10, thereby pinching any picks therebetween. By selecting a compression spring having appropriate force, a suitable combination of reasonable pick insertion force and pick retention force will be achieved for a given jaw surface characteristic and composition. Said another way, the jaw surface, depending upon composition and surface geometry, will have certain static and dynamic coefficients of friction. These coefficients of friction in combination with the spring force of compression spring 45 and the coefficients of friction of the pick, will determine pick insertion and retention forces.

Other techniques may be used to further assist with insertion and retention, such as special coatings or surface treatments applied to jaws 10, 20 or to the picks themselves. However, in the preferred embodiments, it is most preferable to use commercially available and unaltered picks, such that a musician may even produce their own custom pick and use the same with the present invention, thereby permitting the musician the greatest artistic freedom possible. Consequently, at the time of design of an embodiment of the invention, a designer may optionally provide "fish scales", saw teeth, or other surface geometries which provide less resistance to pick insertion and greater resistance to removal, but, again, in the preferred embodiments such directional surface geometries or special surface coatings or treatments are not felt to be necessary other than suitable surface treatments where desired to provide coloring, corrosion protection, and other known benefits. Appropriate surface treatments may include, for exemplary purposes only and not limited thereto, paint, powder coating, anodization, or other well-known surface treatments and coatings.

If only one rod or post such as shoulder bolt 40 is used, and absent any other technique for guiding jaw 20, moving jaw 20 may tend to rotate about the axis of bolt 40, and bolt 40 may also become misaligned with the axis of bore 14, either which is relatively undesirable. Rotation of moving jaw 20 about bolt 40 may occur in both clockwise and counterclockwise directions, limited by contact between moving jaw 20 and leg 16 at surface 17, as an instrument is being played or transported. In such case, picks 70 will be shifted about and will eventually work themselves from between jaws 10, 20. Misalignment between shoulder bolt 40 and bore hole 14 may result in increased sliding friction and possible binding therebetween, which could cause moving jaw 20 to no longer be resiliently biased by spring 45 towards fixed jaw 10. In order to prevent either of these two undesirable events from occurring, in the preferred embodiment two springs 45, 55 are illustrated, though it will be apparent that one or a plurality of such springs may be used. Springs 45, 55 are supported upon shoulder bolts 40, 50, where shoulder bolt 50 has a head 51, shoulder 52 and threaded end 53 of similar construction and function as like features found and described herein above with regard to shoulder bolt 40. The use of at least two shoulder bolts 40, 50 within at least two bores 14, 15 in combination with at least two springs 45, 55 maintains sufficient angular alignment to prevent the undesirable rotation and angular misalignment described herein above. Nevertheless, from the teachings presented herein, it will become apparent to those skilled in the mechanical arts that other types of guides and bearings may be used which would maintain proper angular alignment between fixed jaw 10 and moving jaw 20, and likewise other constructions which will apply a compressive force therebetween. Nevertheless, the preferred embodiments are constructed as described owing to the low cost and ready availability of shoulder bolts and springs, and the relatively simple geometries used in the design of jaws 10, 20.

To facilitate insertion of a pick such as pick 70 between jaws 10, 20, each of the jaws are preferably provided with a bevel, chamfer, taper or the like immediately adjacent to the gap between jaws. Chamfer 12 is provided adjacent to top surface 11 in fixed jaw 10, while chamfer 22 is provided adjacent to top surface 21 in fixed jaw 20. The exact shape and geometry may be varied to suit a particular application, but the purpose remains to facilitate single-handed insertion of a pick or other musical accessory.

When one or more picks 70 are inserted between jaws 10, 20, there is a possibility that they may slide in a direction from top surfaces 11, 21 towards adhesive 60 which is distal to the top surfaces. To prevent one or more picks from simply passing through jaws 10, 20 during insertion, a travel limit is created by surface 17 on leg 16. A pick or other accessory may only be inserted until contact is made with surface 17. The displacement of surface 17 from top surfaces 11, 21 will determine how much of a pick or other accessory is held between jaws 10, 20. This distance should be great enough to provide adequate retention forces, but will most preferably not be so great that smaller accessories will slide completely between jaws 11, 21 and become inaccessible by human fingers.

Springed pick pincher 1 is designed so that fixed jaw 10 may be provided with suitable adhesive 60, thereby enabling surface adhesive mounting onto and extending exterior to a stringed instrument surface. Adhesive 60 may be any suitable holding means, and may for exemplary purposes and not limited thereto include double-sided adhesive tape, thermoset and thermoplastic glues, Velcro, or even bolts, screws or other fasteners. However, the use of an adhesive tape or the like is most preferred, since such materials are commonly produced to be non-marring and subsequently removable from a surface, even a delicate surface such as found on many musical instruments. This springed pick pincher 1 is therefore applicable to any musical instrument, whether already in existence or yet to be produced.

While leg 16 is illustrated in preferred embodiment springed pick pincher 1, leg 16 having surface 17 is, in fact, optional as well. A suitable surface may be formed directly by the musical instrument upon which springed pick pincher 1 is adhesively mounted. However, without leg 16, picks and other accessories will repeatedly contact the underlying instrument surface, potentially permanently marring the surface over time. Further, in the event moving jaw 21 is hit or otherwise deviates form proper alignment, then the surface of the instrument may also be marred by contact with moving jaw 21. Consequently, leg 16 is most preferable in springed pick pincher 1.

Figure 6:
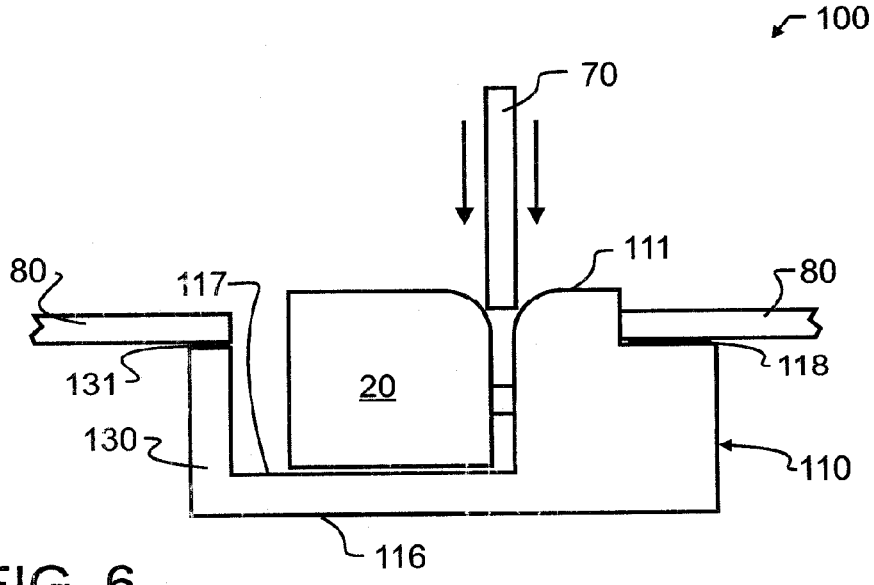
FIG. 6 illustrates a second preferred embodiment springed pick pincher designed in accord with the teachings of the present invention from a side plan view, installed internally within a stringed instrument and illustrating the insertion of a pick therein.

FIG. 6 illustrates springed pick pincher 100, of similar construction to springed pick pincher 1. Identical components are identified by identical reference numerals in both embodiments. Similar components are distinguished between the embodiments by the presence of a numeral one in the hundreds position, such that fixed jaw 110 is different from but very similar to fixed jaw 10 in appearance and function. In the case of fixed jaw 110, a cut-out from surface 111 is provided to form bonding surface 118, against which a thin layer 80, such as might be comprised by a wall of a guitar or other musical instrument, may be coupled or bonded. Once again, the particular method of coupling is not critical to the present invention, but adhesive bonding will generally provide adequate strength and durability while avoiding marring or otherwise damaging layer 80. Leg 116 is also modified, to provide an extension 130. Terminating extension 130 is a bonding surface 131 which provides additional anchoring for fixed jaw 110 to surface 80. From this illustration, it should be apparent that springed pick pincher 100 may be mounted interior to a stringed instrument, and so may for exemplary purposes be assembled within an acoustic guitar body at the time of manufacture of the acoustic guitar.

Figure 5:
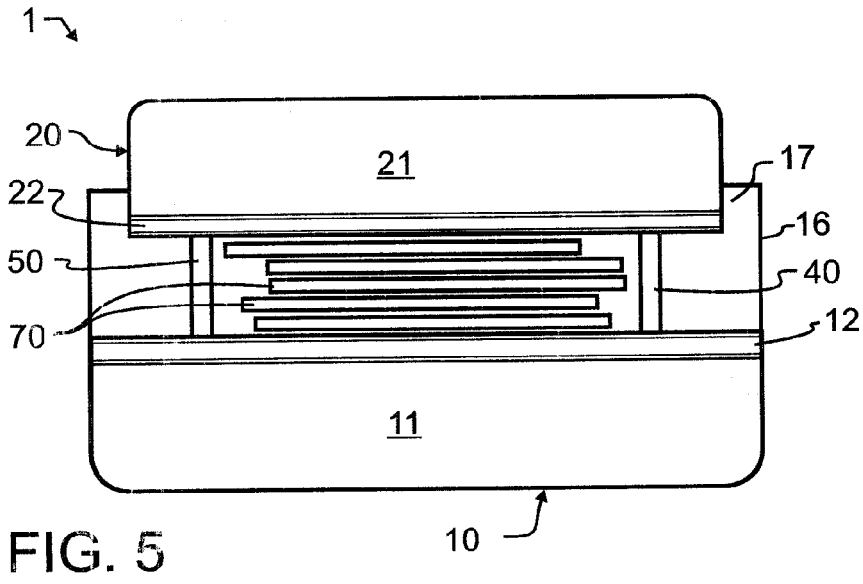
FIG. 5 illustrates the first preferred embodiment springed pick pincher of FIG. 1 from a top plan view and further operatively combined with a plurality of picks stored therein.

In either embodiment, picks 70 or other similar accessories may be oriented perpendicular to instrument surface 80, and one or a plurality of these picks 70 may be inserted into and removed from between jaws 10 or 110 and 20. Where a plurality of picks 70 are inserted, such as shown in FIG. 5, any of these picks may be selectively removed. While the pick most adjacent to moving jaw 20 and the pick most adjacent to fixed jaw 10 are the most easily accessed, it will be apparent to those familiar with the playing of stringed instruments that either picks 70 will all be of like geometry and construction, in which case accessing either will be adequate, or there will be differences in geometry or construction between the picks. When there are differences in geometry, a musician may, without looking at springed pick pincher 1, 100, manually identify a desired pick and remove the same from springed pick pinchers 1, 100.

Many materials are suitable for the construction of springed pick pinchers 1, 100, and may typically include various plastics, metals, and composites. When aluminum is used, the surface of the aluminum may be anodized to take a desired color, though nearly any metal or plastic may similarly be colored. Metals may be relatively simply machined, and likewise, plastics may be readily machined or molded, owing to the desirably simple geometry used in the preferred embodiments. In the preferred embodiments, all components are rigid through all use, with the exception of compression springs 45, 55. The use of rigid components is most preferred, since such components ensure proper relative movement between jaws 10 or 110 and 20 through the insertion of a pick, plectrum, or the like, and since such components are easily manufactured and assembled. Finally, the use of rigid jaws ensures that the jaws will move or travel upon insertion of a pick, rather than deforming without travel. Deformation of the jaws would undesirably result in surface wear and a potential to be snagged by the pick, which would in turn block or restrict pick insertion and would create a potential for tearing or other damage.

While the foregoing details what is felt to be the preferred embodiment of the invention, no material limitations to the scope of the claimed invention are intended. Further, features and design alternatives that would be obvious to one of ordinary skill in the art are considered to be incorporated herein. As but one example, more than one moveable jaw 20 may be associated with a single fixed jaw 10. In this variation, the single fixed jaw 10 or 100 would extend to the combined width of each movable jaw, and a plurality of shoulder bolts, two for each moveable jaw, would then pass into the fixed jaw. From this additional description, it should be apparent that there are many contemplated variations, which are simply too numerous to individually describe herein. Consequently, the scope of the invention is set forth and particularly described in the claims herein below.

I claim:

1. A holder for picks and other stringed musical instrument accessories, comprising:

a fixed jaw having a body, a top surface, a bottom surface, and a pick retention surface;

a moving jaw having a body, a top surface, a bottom surface, and a pick retention surface;

at least one longitudinally extensive member spanning between said fixed jaw and said moving jaw and serving as a guide that limits relative movement between said fixed and moving jaws;

at least one bore extending within said fixed jaw and receiving said at least one longitudinally extensive member; and at least one force applicator urging said moving jaw towards engagement with said fixed jaw, wherein said least one force applicator further comprises a spring captured within said at least one bore and acting to apply a force between said at least one bore and said at least one longitudinally extensive member.

2. The holder for picks and other stringed musical instrument accessories of claim 1, wherein said least one force applicator further comprises a compression spring.

3. The holder for picks and other stringed musical instrument accessories of claim 1, wherein said fixed jaw body and said moving jaw body further comprise rigid bodies.

4. The holder for picks and other stringed musical instrument accessories of claim 3, wherein said at least one longitudinally extensive member further comprises a rigid rod-shaped body.

5. The holder for picks and other stringed musical instrument accessories of claim 4, wherein said at least one longitudinally extensive member further comprises a shoulder bolt having a head terminating a first longitudinal end, a smooth cylindrical shoulder, and a thread adjacent to a second longitudinal end distal to said head.

6. The holder for picks and other stringed musical instrument accessories of claim 1, wherein said at least one bore extends within said fixed jaw normal to said pick retention surface.

7. An apparatus for pinching and retaining stringed musical instrument picks to a stringed musical instrument, comprising:

a rigid fixed jaw having a body, a top surface, a bottom surface, a pick retention surface extending between said top and bottom surfaces, and first and second bores extending through said pick retention surface;

a rigid moving jaw having a body, a top surface, a bottom surface, and a pick retention surface;

first and second bolts rigidly anchored to said moving jaw and protruding therefrom, each having a shaft and terminating distal to said moving jaw at a head, said first bolt extending into said first bore and said second bolt extending into said second bore;

a first compression spring within said first bore and concentric about said first bolt, applying a force between said first bolt head and said first bore, and thereby urging said moving jaw towards engagement with said fixed jaw; and a second compression spring within said second bore and concentric about said second bolt, applying a force between said second bolt head and said second bore, and thereby urging said moving jaw towards engagement with said fixed jaw.

8. The apparatus for pinching and retaining stringed musical instrument picks to a stringed musical instrument of claim 7, further comprising an adhesive coupler defining a coupling between said rigid fixed jaw and a body of said stringed musical instrument.

9. The apparatus for pinching and retaining stringed musical instrument picks to a stringed musical instrument of claim 7, wherein said rigid jaw further comprises:

a leg extending beneath and wrapping about at least two sides of said rigid moving jaw;

a first surface mount coupling adjacent to said rigid jaw top surface; and a second surface mount coupling adjacent to said leg and distal to said rigid jaw top surface;

said first and second surface mount couplings defining a coupling to a body of said stringed musical instrument.

10. The apparatus for pinching and retaining stringed musical instrument picks to a stringed musical instrument of claim 7, wherein said first and second bores extend normal to said pick retention surface.

11. The apparatus for pinching and retaining stringed musical instrument picks to a stringed musical instrument of claim 7, wherein said first and second bolts further comprise rigid shoulder bolts.

* * * * *